US007883295B2

(12) United States Patent
Schellhorn

(10) Patent No.: US 7,883,295 B2
(45) Date of Patent: Feb. 8, 2011

(54) METHOD AND APPARATUS FOR FORMING AN IN SITU SUBTERRANEAN SOIL CEMENT STRUCTURE HAVING A CYCLONIC MIXING REGION

(76) Inventor: Verne L. Schellhorn, 32987 Highway 1 South, Gualala, CA (US) 95445

( * ) Notice: Subject to any disclaimer, the term of this patent is extended or adjusted under 35 U.S.C. 154(b) by 0 days.

(21) Appl. No.: 12/383,555

(22) Filed: Mar. 24, 2009

(65) Prior Publication Data

US 2009/0257829 A1 Oct. 15, 2009

Related U.S. Application Data

(60) Provisional application No. 61/123,627, filed on Apr. 10, 2008, provisional application No. 61/127,218, filed on May 9, 2008, provisional application No. 61/133,495, filed on Jun. 30, 2008.

(51) Int. Cl.
*E02D 5/34* (2006.01)

(52) U.S. Cl. ..... 405/241; 405/233; 405/266; 405/267; 405/269

(58) Field of Classification Search ..... 405/231, 405/232, 233, 236, 240, 241, 242, 252.1, 405/253, 266, 267, 269
See application file for complete search history.

(56) References Cited

U.S. PATENT DOCUMENTS 3,485,052 A * 12/1969 Turzillo ..... 405/241
3,690,109 A * 9/1972 Turzillo ..... 405/241
4,327,507 A * 5/1982 Volbeda ..... 175/67
4,433,943 A * 2/1984 Pao Chen ..... 405/241
4,637,758 A * 1/1987 Tamaki et al. ..... 405/248
4,793,740 A * 12/1988 Schellhorn ..... 405/232
5,378,085 A * 1/1995 Kono et al. ..... 405/241
6,116,819 A * 9/2000 England ..... 405/241
7,546,887 B2 * 6/2009 Schwab ..... 405/241
2004/0105728 A1 * 6/2004 Schmidmaier et al. ..... 405/241
2006/0013656 A1 * 1/2006 Blum ..... 405/241

FOREIGN PATENT DOCUMENTS

GB 2137678 A * 10/1984
JP 56142923 A * 11/1981

* cited by examiner

*Primary Examiner*—Frederick L Lagman
(74) *Attorney, Agent, or Firm*—Bruce H. Johnsonbaugh

(57) ABSTRACT

A method and apparatus are provided for forming an in situ subterranean soil cement structure wherein a soil processing tool incorporates a novel cyclonic mixing region. The cyclonic mixing region is formed by deflecting a jetstream which initially moves away from a hollow Kelly and, after being deflected, the jetstream is redirected into a direction flowing towards the hollow Kelly. A contoured flight is provided having an exterior contoured surface extending upwardly from a central section of the contoured flight and bends through an angle greater than 110° in order to deflect a jetstream which is directed outwardly from the hollow Kelly back towards the hollow Kelly. By preventing any of the high pressure jetstreams from impacting the side wall of the hole, higher jetstream velocities and pressures may be utilized. Two or more jetstreams may also be utilized to direct their jetstreams around a central horizontal axis to provide the cyclonic mixing region. A preferred embodiment is designed for use in clay subsoil typically found in the Gulf Coast region of the United States. This preferred embodiment utilizes a support structure strengthening the tool and also utilizes a flat bottom with cutting teeth extending downwardly below the flat bottom surface of the tool.

26 Claims, 18 Drawing Sheets

METHOD AND APPARATUS FOR FORMING AN IN SITU SUBTERRANEAN SOIL CEMENT STRUCTURE HAVING A CYCLONIC MIXING REGION

CROSS-REFERENCE TO RELATED APPLICATIONS

This application claims the benefit of and priority from three United States provisional patent applications:

1) Ser. No. 61/123,627 filed Apr. 10, 2008
2) Ser. No. 61/127,218 filed May 9, 2008
3) Ser. No. 61/133,495 filed Jun. 30, 2008

BACKGROUND AND BRIEF SUMMARY

The present invention relates generally to systems utilized to form in situ underground soil cement columns and other subterranean structures, wherein the systems combine mechanical cutting with a high pressure slurry jetstream to break down and mix subsoil and slurry. More particularly, the present invention provides a method and apparatus which achieves an extremely high level of turbulence in a region described herein as a "cyclonic mixing region." The cyclonic mixing region enhances the efficiency of the mixing process.

The present invention represents a significant improvement over my prior patents that relate to various apparatus and methods for creating various types of soil cement structures underground. Those patents include U.S. Pat. Nos. 4,793,740; 4,958,962; 5,396,964; 5,890,844; 6,183,166; 6,241,426; 6,988,856 and 7,377,726, all of which are incorporated herein by reference.

A limitation of the prior art systems is the efficiency with which the combination of mechanical cutting combined with hydraulic mixing breaks down particles of underground subsoil. The present invention increases the efficiency of the process by creating for the first time a region which resembles a cyclone and in which tremendous amounts of turbulence are created to enhance the process of breaking down, mixing and fluidizing the underground material; this increased efficiency is most important in clay subsoil, such as the clay found in the Gulf Coast region of the United States. The increased efficiency of the present invention allows operation either at higher pressures and velocities with improved results or at lower pressures and lower velocities with the same results.

Another problem with many of the prior art systems is that the high pressure stream of cement slurry may impact the side wall of the hole being created. This impact can degrade the integrity of the hole in some types of soil by washing away portions of the side wall. A significant aspect of the present invention is to prevent this extremely high energy jet stream from hitting and degrading the side wall of the hole being formed. Another significant advantage of the invention is that, by preventing degradation of the side walls, a much higher injection pressure and velocity may be utilized.

A further disadvantage of the prior art systems is that, as the tool is being retracted from the hole, in some situations the tool interacts negatively with the side wall of the hole, causing small portions of the side wall to break off, weakening the integrity of the hole. The present invention overcomes that problem by including a smooth exterior surface which acts as a trowel to preserve the integrity of the side walls as the apparatus is withdrawn from the hole.

A primary object of the invention is to provide a cyclonic mixing region in a subterranean soil processing tool which produces an increased level of turbulence that increases the speed and effectiveness of the process of breaking down particles of under-ground subsoil, particularly clay, and mixing and fluidizing the particles of underground subsoil to form soil cement structures.

A further object of the invention is to provide a subterranean soil processing method and apparatus in which the high pressure stream of cement slurry is deflected and redirected into a direction in which the jetstream does not impact the side wall of the hole; this deflection of the jetstream away from the side wall of the hole allows the use of higher slurry pressures and velocities compared with the slurry pressures and velocities usable in prior art systems.

A further object of the present invention is to reduce the negative interaction with a soil processing tool with the side wall of the hole as the soil processing tool is being withdrawn from the hole; the present invention provides an exterior surface which tends to trowel and smooth the side wall of the hole as the soil processing tool is retracted upwardly out of the hole.

Further objects and advantages will become apparent from the following description and the drawings.

DETAILED DESCRIPTION OF THE DRAWINGS

Figure 1:
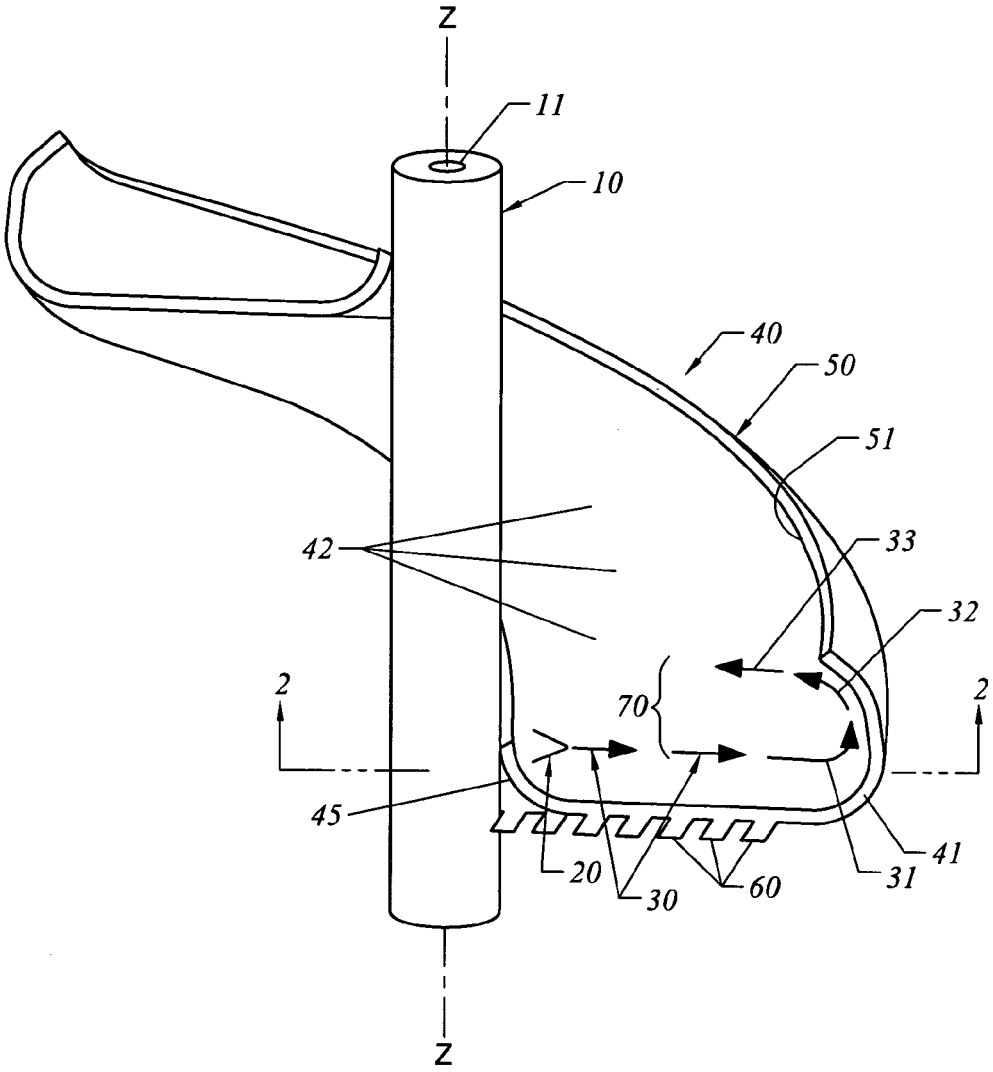
FIG. 1 is a schematic representation of a first embodiment of the invention.

FIG. 1 illustrates in a conceptual sense the first embodiment of the present invention. FIG. 1 (as well as other Figures) is not drawn to scale, but is drawn to exaggerate the important components of the present invention. A hollow Kelly 10 is provided having a central passageway 11 through which a high pressure water based cementitious slurry (or other solidifying agent) is injected into a subterranean situs. This high pressure slurry is fed into a nozzle 20 and is ejected as a high pressure stream of slurry shown by arrows 30. Hollow Kelly 10 carries a flight with cutting teeth 60 to mechanically cut and break the subsoil into pieces as the tool is advanced into the situs. The use of a hollow Kelly with mechanical cutting teeth, together with one or more high pressure nozzles to assist in hydraulically dividing and breaking down those pieces into fine particles of subsoil, is known in the art. The high pressure jetstream from one or more nozzles forms a uniform admixture of the solidifying agent (cementitious slurry) and fine particles. The admixture is then allowed to harden, as known in the art.

According to the present invention, a novel contoured flight 40 having a cutting edge 41 is provided. The cutting edge 41 carries a plurality of mechanical cutting teeth 60. Contoured flight 40 includes a central section 42 against which clay (or other subsoil) fragments run as the hollow Kelly 10 is rotated and the teeth 60 cut a slab of clay subsoil into typically a one inch thickness. In the embodiment shown in FIG. 1, the contoured flight 40 has a cross section that includes an inner contoured section 45 and an exterior contoured section shown generally as 50. The inner contoured section 45 is connected rigidly as by welding to the auger stem 10. The inner section 45 includes an arc of approximately 90° extending from the auger 10 downwardly to a central generally planar central section 42 of the contoured flight 40. Contoured flight 40 may have alternate shapes as described below.

The exterior contoured section 50 includes a preferably curved section of material in FIG. 1 that extends upwardly from central section 42 and bends through an arc of approximately 120°, terminating in an upper edge 51. The arc formed by section 50 could be 110° to 200°. The surface of exterior contoured section 50 is preferably arcuate, but could include other shapes as well so long as the exterior contoured section bends through an angle greater than 110°. The purpose of the exterior contoured section 50 is to deflect the jetstream 30, as shown by arrows 31, 32 and 33, to redirect the energy of the jetstream 30 back toward hollow Kelly 10 into a region above the planar surface of central section 42 of contoured flight 40. This region, shown generally as 70 in FIG. 1, forms a "cyclone" wherein jetstream 30 moves in a direction radially outwardly from hollow Kelly 10 and a secondary jetstream 33 which is a portion of jetstream 30 that has been deflected off of external curved section 50 backwardly into a direction moving towards hollow Kelly 10. This region of jetstreams moving in opposite directions and moving around a generally horizontal axis passing through point 71 (FIG. 2) creates high turbulence which accelerates (and makes more efficient) the breakdown of the clay particles being severed mechanically by teeth 60 into small fluidized particles used in the soil cement column. It is also significant to note that exterior curved section 50 prevents jetstream 30 from impacting the side wall of the hole being formed.

Contoured flight 40, as shown in FIG. 1, follows a steep helical path around hollow Kelly 10, but other configurations or pathways could also be used. Contoured flight 40 subtends an arc around the vertical axis Z-Z of Kelly 10 of approximately 180° (see FIG. 3).

The present invention may be utilized in large machines having two or more parallel hollow Kellys.

Figure 2:
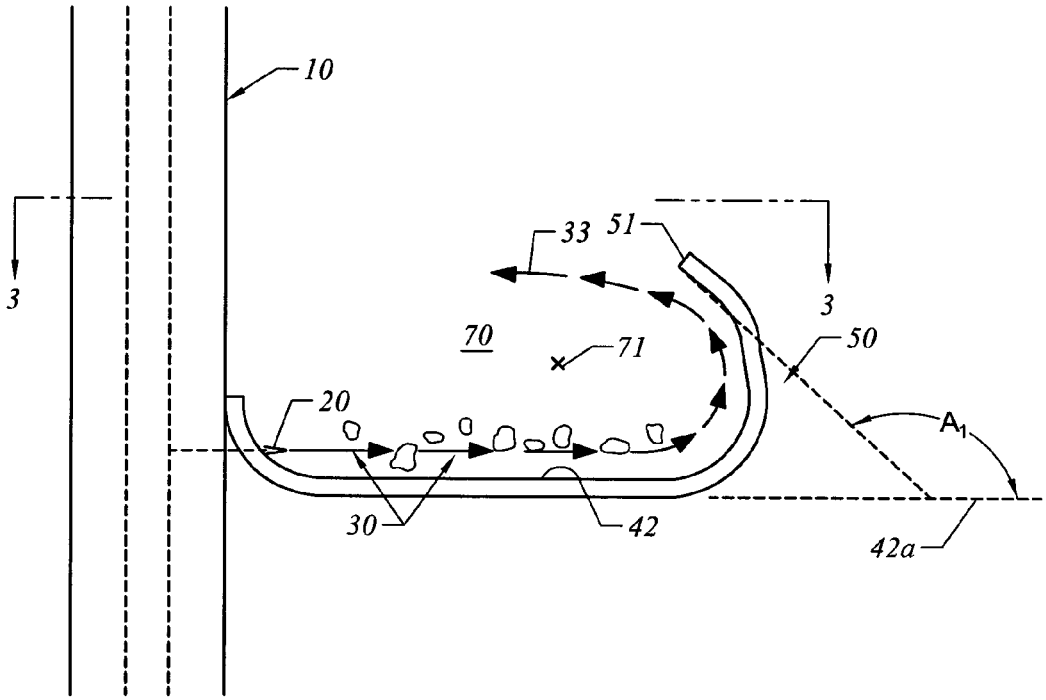
FIG. 2 is a sectional view on the line 2-2 of FIG. 1 and illustrates conceptually the cyclonic mixing region of the invention.

FIG. 2 is a sectional view on the line 2-2 of FIG. 1. The central "cyclonic region" 70 is formed between jetstream 30 (formed by high pressure slurry passing through nozzle 20) moving outwardly away from hollow Kelly 10 in a direction parallel to planar central section 42 and secondary jetstream 33 moving in a direction radially inwardly toward hollow Kelly 10 after jetstream 30 has been deflected by the outer curved surface 50. As shown in FIG. 2, the angle formed between the geometrical extension 42*a* of generally flat central section 42 and a tangent near upper edge 51 of curved section 50 forms an angle $A_1$ which in FIG. 2 is approximately 120°. Curved section 50 therefore forms a total angle of approximately 120° through which the jetstream 30 is deflected. The total angle formed by curved section 50 as it bends upwardly may vary from approximately 110° to approximately 180°.

Figure 3A:
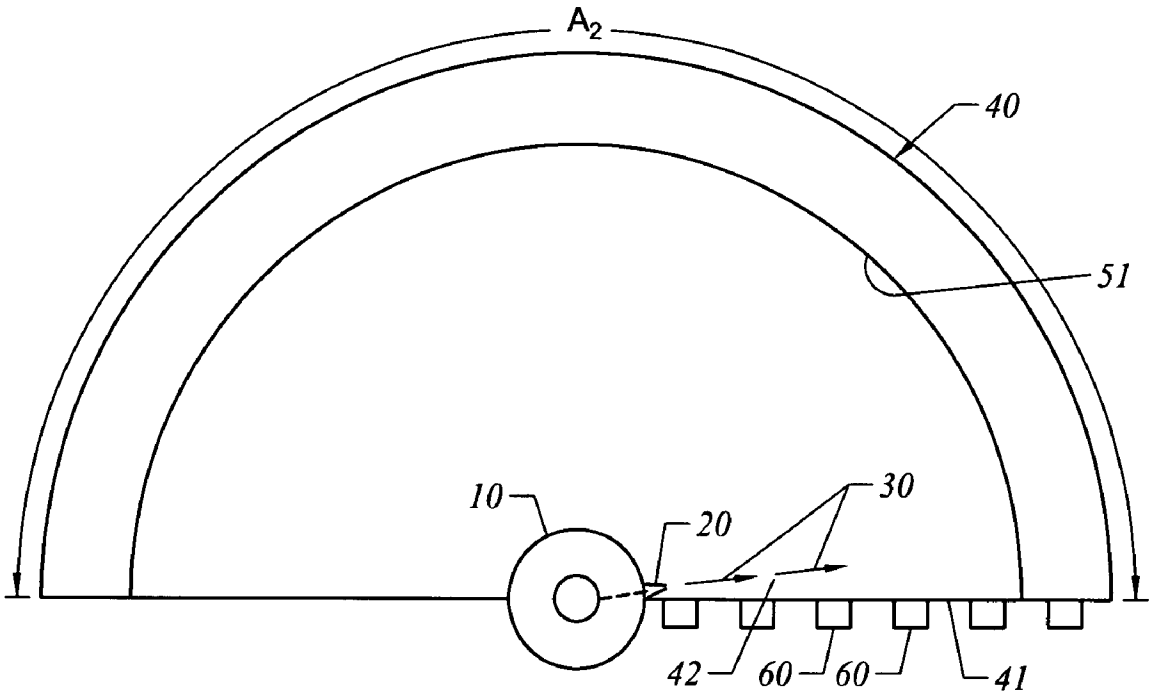
FIG. 3A is a view on the line 3-3 of FIG. 2 and shows the relationship of the jetstream to the cutting edge of the tool.

FIG. 3A is a view on the line 3-3 of FIG. 2 and shows nozzle 20 and jet stream 30 when viewed directly from above. As shown in FIG. 3A, the jetstream 30 extends across the central section 42 of flight 40 in a direction generally parallel to and adjacent to the lower, cutting edge 41 of contoured flight 40. FIG. 3A shows the arc $A_2$ of approximately 180° through which contoured flight 40 extends.

Figure 3B:
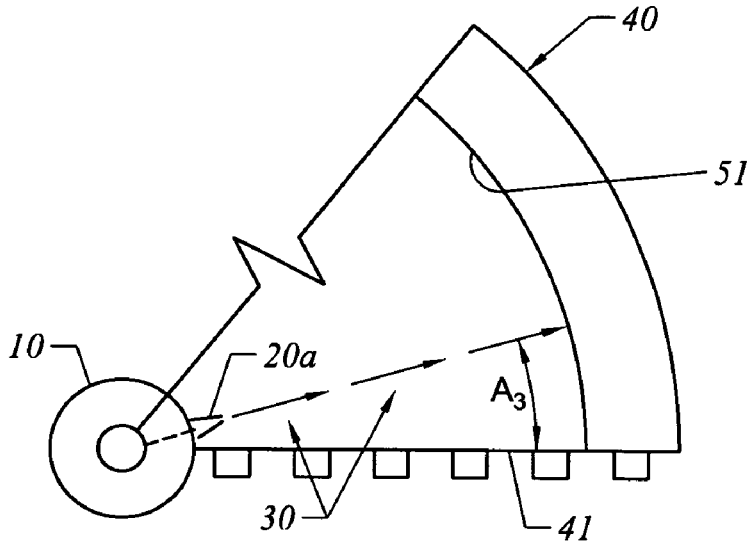
FIG. 3B illustrates an embodiment similar to that shown in FIG. 3A but wherein the slurry jetstream is oriented at an angle to the cutting edge of the tool.

As shown in FIG. 3B, the angular orientation of the output jet stream 30 of nozzle 20*a* may be varied so that the jetstream 30 is oriented at a different angle $A_3$ relative to lower, cutting edge 41 than the parallel orientation shown in FIG. 3A. The different orientation shown in FIG. 3B tends to direct the energy of the jet stream in a more upwardly direction relative to contoured flight 40 and produces a slightly different cyclonic region. Angle $A_3$ may range from 0° to 45°.

Figure 4:
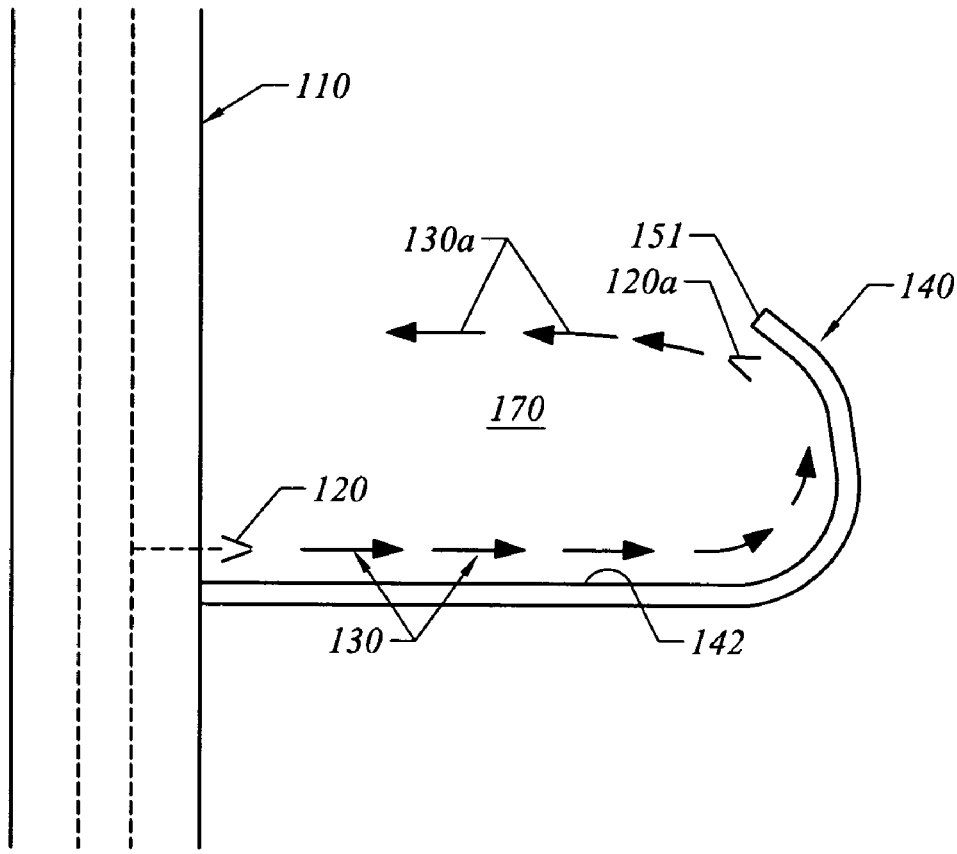
FIG. 4 illustrates a further embodiment of the invention in which two jetstreams are created by two separate nozzles, wherein the nozzles are spaced apart from each other and wherein their jetstreams are oriented in spaced apart parallel and opposite directions.

FIG. 4 illustrates an alternate embodiment of the invention wherein hollow Kelly 110 carries contoured flight 140. Curved flight 140 includes a flat central section 142 that extends inwardly to auger 110. In this embodiment, a first nozzle 120 ejects a stream 130 that extends perpendicularly away from the axis Z-Z of hollow Kelly 110 and parallel to the flat central section 142 of contoured flight 140. A second nozzle 120*a* is provided adjacent the upper edge 151 of flight 140 and ejects a second jetstream 130*a* that is directed radially inwardly toward hollow Kelly 110. The embodiment of FIG. 4 utilizes a pair of nozzles with their jetstreams oriented in parallel but opposite directions and spaced apart vertically to create a central "cyclonic region" 170 of generally elliptical shape and having extreme and violent turbulence.

Figure 5:
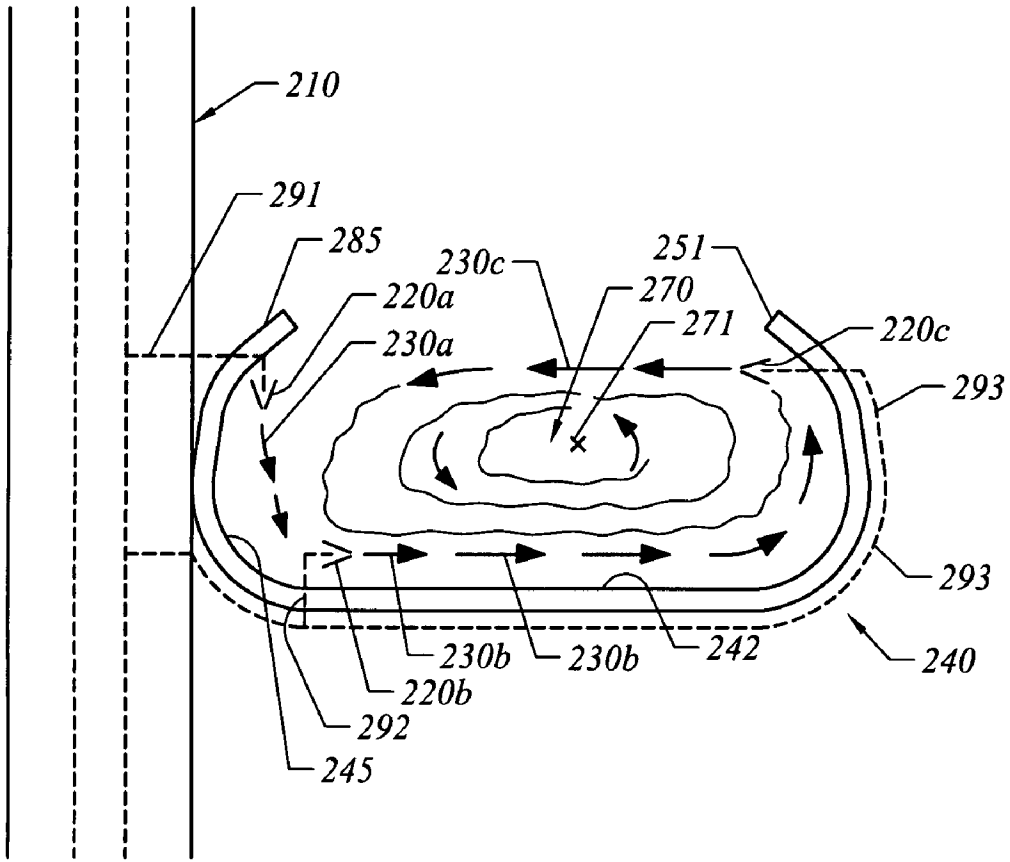
FIG. 5 illustrates a third embodiment of the invention utilizing three nozzles to generate three separate jetstreams to form a cyclonic mixing region.

FIG. 5 illustrates yet another embodiment wherein hollow Kelly 210 carries a contoured flight 240. An inner curved section 285 adjacent stem 210 forms a downwardly extending arc of about 90°. In this embodiment, a series of three nozzles is provided to create turbulent zone 270. A first nozzle 220*a* is carried adjacent the surface of hollow Kelly 210 by an upper curved section 285 and ejects a jetstream 230*a* which extends in a direction downwardly parallel to axis Z-Z. A second nozzle 220*b* is mounted slightly above the central planar region 242 of contoured flight 240 and directs its jet stream 230*b* radially outwardly from hollow Kelly 210 and generally horizontal and parallel to the central surface 242. A third nozzle 220*c* is mounted adjacent the upper edge 251 of flight 240 and ejects a jet stream 230*c* directed horizontally toward hollow Kelly 210. Cementitious slurry is fed to the nozzles through high pressure lines 291, 292 and 293, shown as dashed lines for clarity. The three output jetstreams are spaced apart around a horizontal axis extending through point 271 and oriented to form a counterclockwise motion in cyclonic region 270. The combination of three nozzles, shown in FIG. 5, forms an extremely turbulent region 270 which accelerates the breakdown of soil particles into a fluidized soil cement slurry.

If the hollow Kelly 210 is rotated at 60 rpm, and if the velocity of the jetstreams is about 450 feet per second, and if the radius of the soil cement column being formed is 2 feet, the cyclonic mixing region 270 will form a vortex that rotates at between 3,000 and 5,000 rpm. The massive turbulence created by such a rapidly rotating vortex will accelerate the breaking down of clay fragments into a soil cement slurry.

Figure 6:
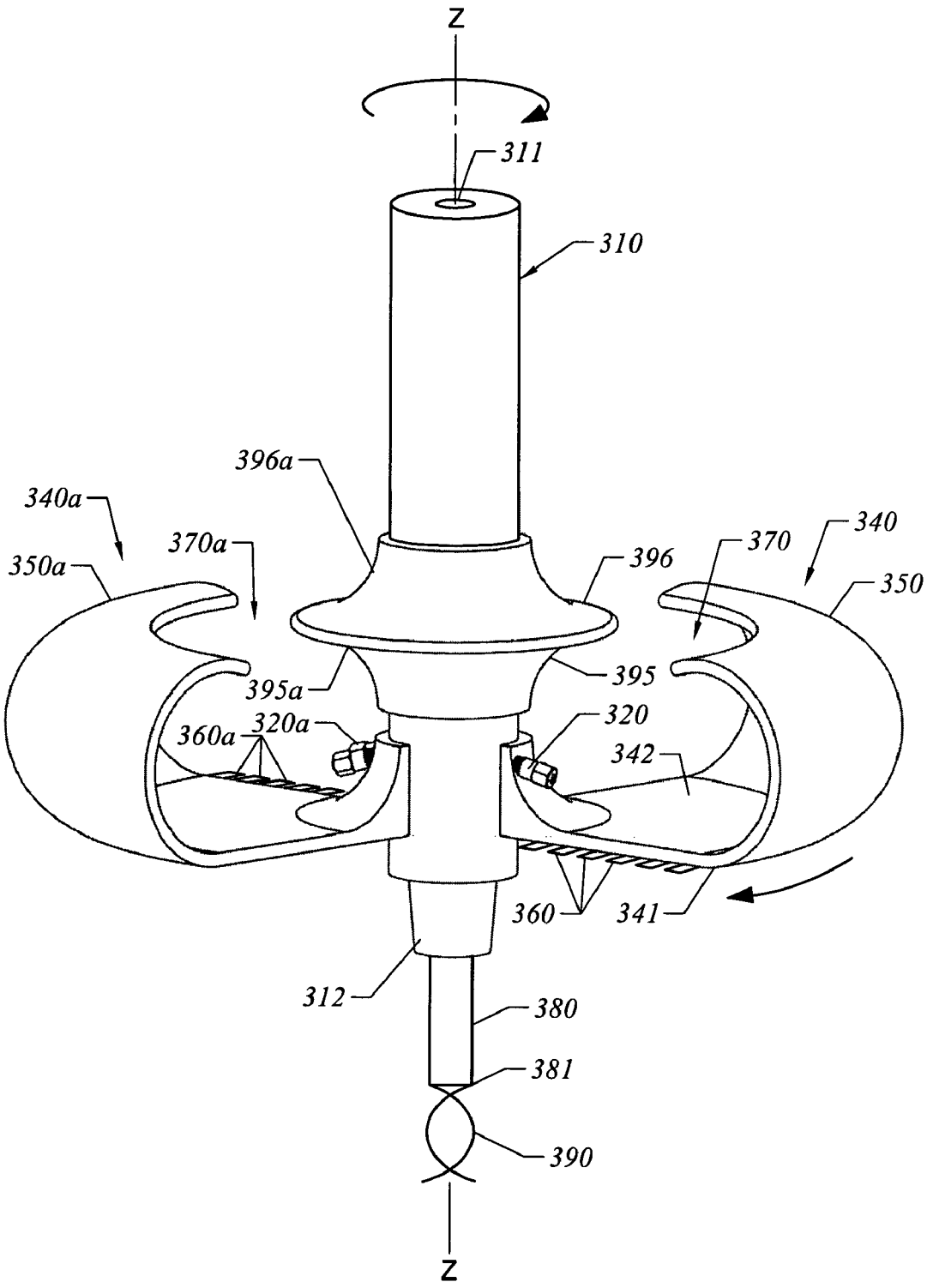
FIG. 6 is a perspective view of a further embodiment of the invention in which two separate contoured flights are utilized, wherein each contoured flight has its own cutting edge.

FIG. 6 is a conceptual drawing of a further embodiment of the present invention. Hollow Kelly 310 has a central passageway 311 through which high pressure cementitious slurry is injected.

The embodiment shown in FIG. 6 uses a pair of contoured flights 340 and 340*a* having cutting teeth 360 and 360*a*, respectively. Each contoured flight 340, 340*a* forms an arc of approximately 90° around vertical axis Z-Z of hollow Kelly 310. It is significant to note that hollow Kelly 310 does not need a continuous helical flight that extends upwardly from cutting teeth 360 to the machine which is driving the Kelly 310. All that is necessary for the sake of the present invention are the two contoured flights 340 and 340*a* to perform the function of the present invention. Contoured flights 340, 340*a* each have a single nozzle 320 and 320*a* that is mounted adjacent hollow Kelly 310 and which is inclined downwardly from the horizontal approximately 15°, but other downward angles up to 30° could be utilized.

A pilot 380 is carried at the lowermost end 312 of Kelly 310 and a fish tail bit 390 is mounted at the lowermost end of pilot 380. Pilot 380 may have an additional nozzle mounted at its lowermost end 381 to assist bit 390 in penetrating the subsoil.

FIG. 6 includes upper interior contoured segments 395 and 396 which help to form an elliptical region adjacent hollow Kelly 310 in which the "cyclonic mixing" of the present invention is achieved. The interior upper contoured segments 395 and 396 cooperate with outer curved surface 350 in forming the cyclonic mixing region shown generally as 370 and 370*a* in FIG. 6. The use of two contoured flights 340 and 340*a* is preferable to using a single contoured flight as shown in FIG. 1, since the use of two contoured flights will balance the cutting action of the teeth and reduce vibration of the hollow Kelly 310.

The embodiment in FIG. 6 uses contoured flights 340 and 340*a* having a relatively small upwardly inclined angle. The leading edge 341 of flight 340 is approximately 1 inch lower than the trailing edge 342 of flight 340. This shallow angle is in contrast to be relatively steep angle of ascent of contoured flight 40 shown in FIG. 1. The contoured flight of FIG. 1 is inclined upwardly at approximately 60°. The upward angle of inclination can be varied to fit the requirements of the local conditions. The shallow angle illustrated in FIG. 6 would be most appropriate for the relatively soft clay subsoil found in the New Orleans area and in the surrounding Gulf Coast region.

Figure 7:
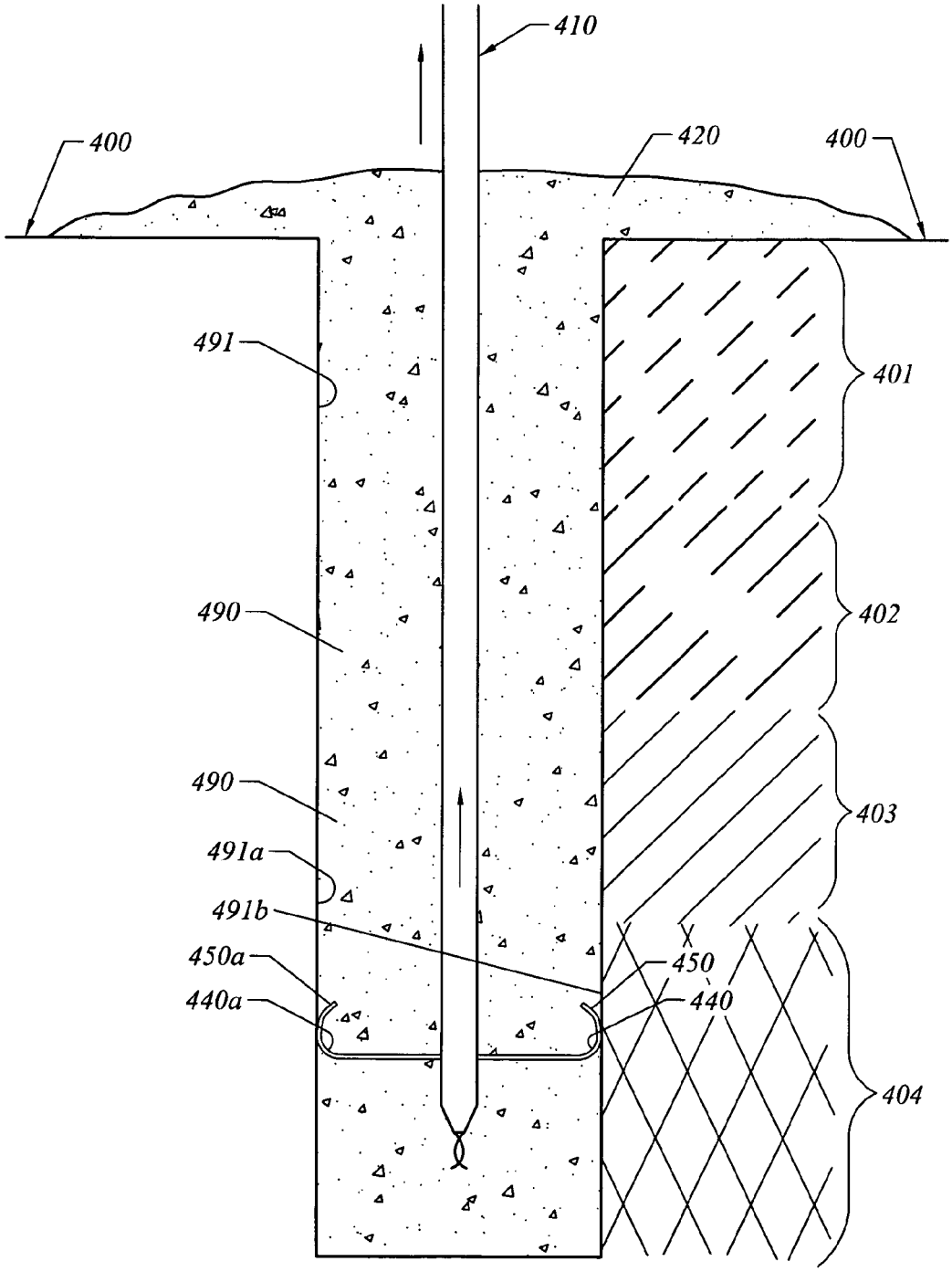
FIG. 7 is a schematic illustration of the tool of the present invention as utilized in soft clay soil typically found in the Gulf Coast Region and showing how the tool tends to trowel the side walls of the hole as the tool is withdrawn from the hole.

FIG. 7 is a sketch showing a soil cement column 490 in the process of being formed by the present invention in the soft clay soil typically found around New Orleans and the Gulf Coast region. The subsoil beneath the ground surface 400 includes four distinct regions 401-404. The uppermost region 401 closest to ground level 400 extends about 20 feet deep and contains a high percentage of organic material, such as peat, and includes much free water. The region 401 is fairly swampy in nature. The second region 402 is about 10 feet in depth and begins approximately 20 feet below ground level and extends to approximately 30 feet below ground level. Region 402 is soft clay that is considerably denser than the top region 401. The third region 403 extends downwardly from a depth of approximately 30 feet to a depth of approximately 45 feet. Region 403 is medium density clay and is considerably firmer than the soft clay of region 402. Region 404 is made of hard clay and extends downwardly from approximately 45 feet below grade level 400. As the soil cement column 490 is being formed, cementitious slurry is introduced into the hole 491 and comprises approximately 20% of the volume of hole 491. The excess subsoil 420 is forced to the surface and accumulates above ground level 400. It is significant to note that the subsoil 420 that is forced upwardly out of hole 491 is primarily the soft, highly organic and swampy clay from region 401. As the soil cement column 490 is being formed, the hard clay from region 404 is forced upwardly into the hole 491 as the soil cement column 490 is being formed.

As the hollow Kelly 410 is raised upwardly after the hole has been completed, as shown in FIG. 7, the upper exterior curved segments 450 and 450*a* of contoured flights 440 and 440*a*, respectively, act as trowels against the side walls 491*a* and 491*b* of hole 491. It is also very significant to note that this troweling effect is very beneficial in the uppermost region of hole 491. This is because the original subsoil in the upper 20 feet of hole 491 has mostly been forced upwardly out of hole 491 and has accumulated as shown at 420 as excess material above ground level 400. This excess material is disposed of after the soil cement column 490 has been formed. The resultant soil cement column 490 has soft and medium clay brought forward into the uppermost 20 foot region of the finished column. The troweling effect of curved sections 450 and 450*a* is significant in that the soft and medium clay is forced outwardly to form a significantly denser soil cement column since most of the organic material and free water has been forced upwardly out of hole 491.

Figure 8:
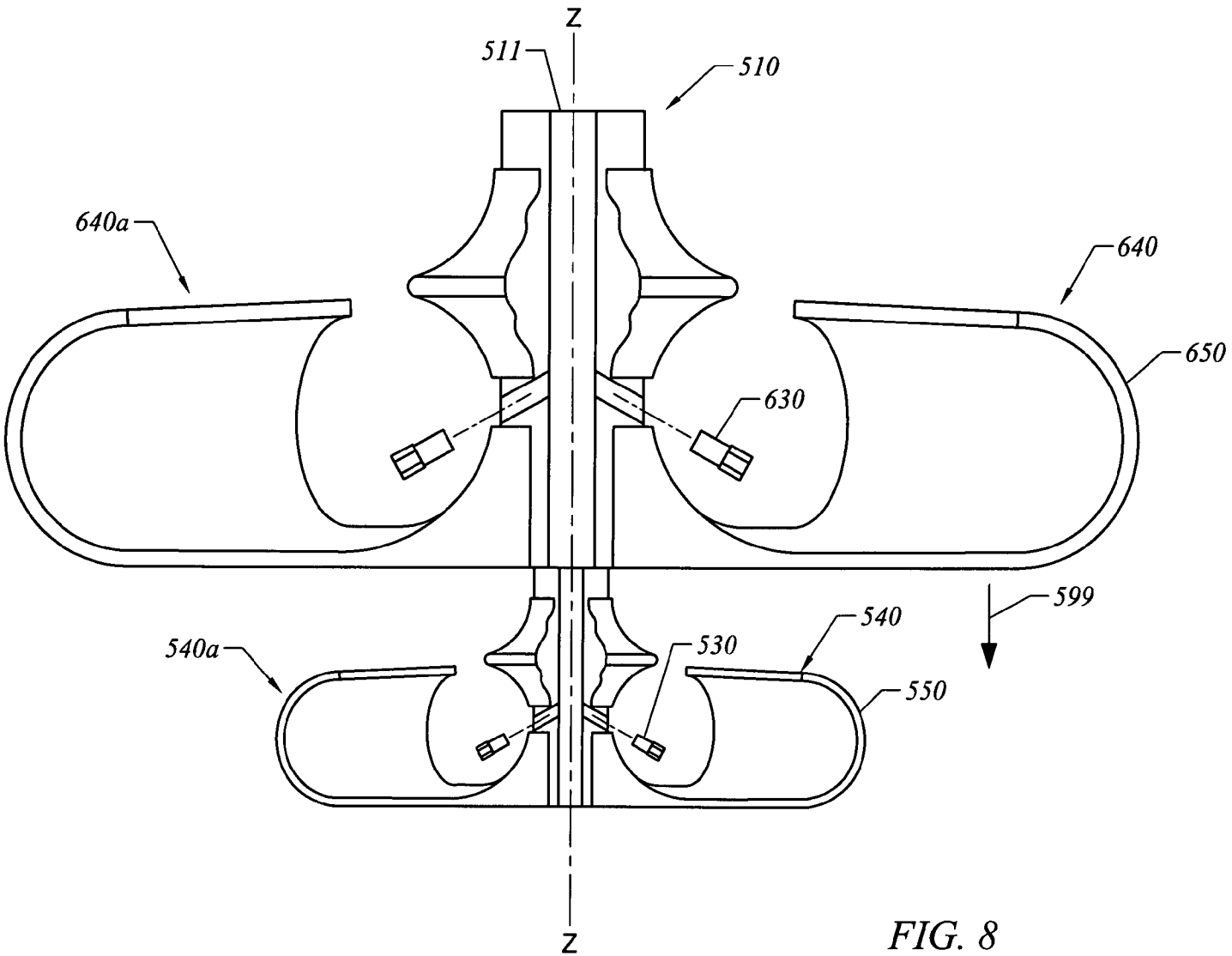
FIG. 8 illustrates a further embodiment of the invention wherein a smaller tool is positioned below the main soil processing tool and the lower tool acts as a pilot for the larger tool.

FIG. 8 illustrates a "two-stage" soil processing tool including a lower or first stage 540 and an upper or second stage 640. The purpose of using a multi-stage tool, as illustrated in FIG. 8, is to improve mixing performance in harder and stiffer clay soils. The small first stage 540 in effect creates a "pilot hole" for the larger second stage 640 as the apparatus is moved downwardly in the direction of arrow 599. As described above, the nozzles 530 and 630 interact with curved sections 550 and 650 to create a region of extreme or violent turbulence which accelerates the mixing of the high pressure cement slurry with the underground soil.

In addition to the "two-stage" tool shown in FIG. 8, three or more stages of tools may be utilized without departing from the spirit of this invention. Furthermore, as shown in FIG. 8, each contoured flight 540, 540*a*, 640 and 640*a* subtends an arc of approximately 90° around the vertical axis Z-Z of hollow Kelly 510. Opposing flights 540*a* and 640*a* are preferably incorporated and are positioned symmetrically on the opposite side of central passageway 511. By positioning the opposed flights in such a symmetrical fashion, unbalanced loads on the hollow Kelly and driving machinery are minimized.

Figure 9A:
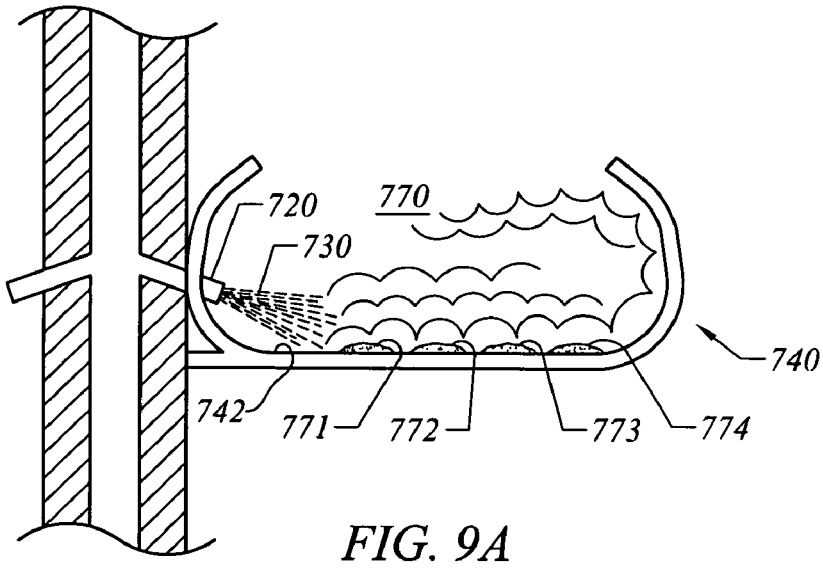
FIG. 9A is a cross-sectional view illustrating the use of an array of ribs on the planar section of the contoured flight to add further turbulence to the system.
Figure 9B:
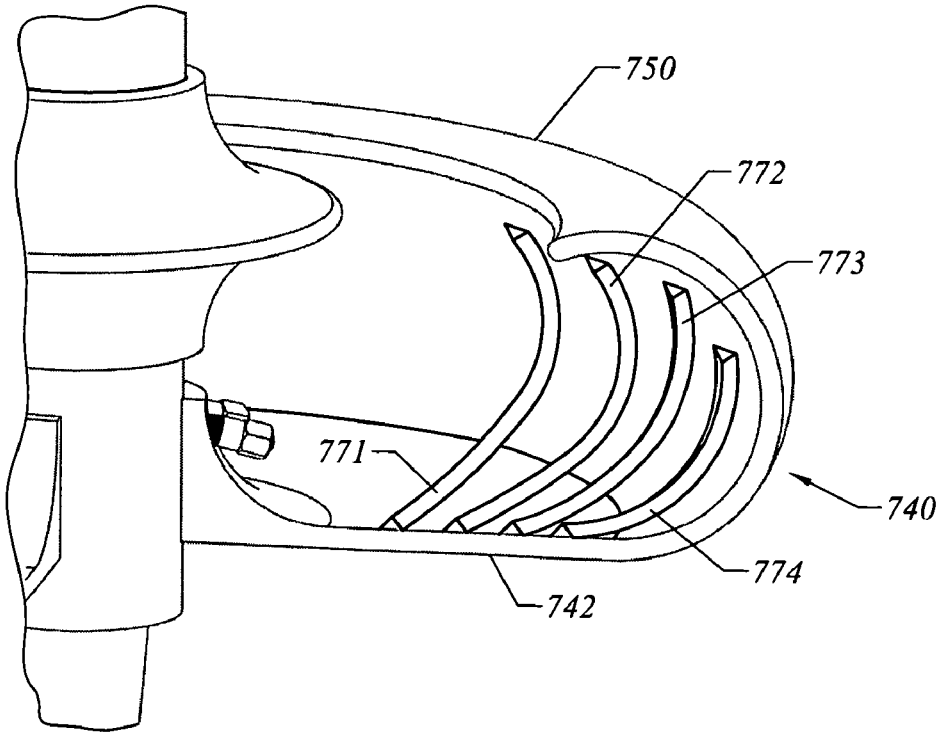
FIG. 9B is a perspective view looking down on a plurality of ribs which extend upwardly onto the curved exterior contoured section of the tool.

FIGS. 9A and 9B illustrate a further aspect of the invention wherein the base or floor of the mixing chamber may be "ribbed" in various manners to increase the turbulence in the mixing chamber. As shown in FIG. 9A, the central planar section 742 of the contoured flight 740 includes a plurality of welded ribs 771-774. Ribs 771-774 tend to increase the turbulence in cyclonic mixing chamber 770 by interacting with the output jet 730 from high pressure nozzle 720. Nozzle 720 is inclined downwardly about 15° relative to planar central section 742. The ribs 771-774 may be made of hardened material to resist the abrasive effect of jetstream 730. As shown in FIG. 9B, which is a perspective view looking down at a portion of contoured flight 740, the welded ribbing strips 771-774 extend across the planar base 742 of contoured section 740 and upwardly along the surface of exterior curved section 750. Various numbers of ribbing strips may be applied to the contoured flight. The ribs may be parallel with each other or may be aligned in an non-parallel fashion. Similarly, the ribbing strips may be curved or serpentine along the surface of contoured flight 740 to increase the overall turbulence in mixing region 770 (shown best in FIG. 9A).

Figure 9C:
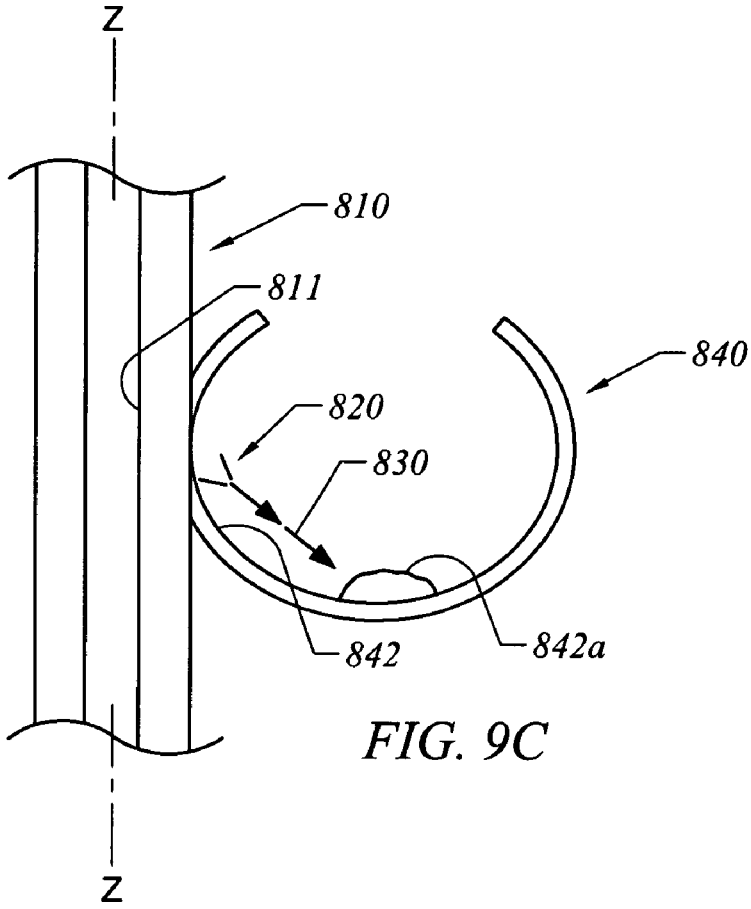
FIG. 9C illustrates a further embodiment of the invention having a flight which is generally curved.

As shown in FIG. 9C, the central section 842 of contoured flight 840 may be curved. As shown in FIG. 9C, the contoured flight 840 has an upwardly concave, arcuate central section 842. Various degrees of curvature may be utilized in central section 842. Hollow Kelly 810 with passageway 811 and longitudinal axis Z-Z supports contoured flight 840. Nozzle 820 introduces jetstream 830. A hardened region 842*a* (tungsten, for example) is formed on central section 842 to resist the abrasive effect of jetstream 830.

Figure 10:
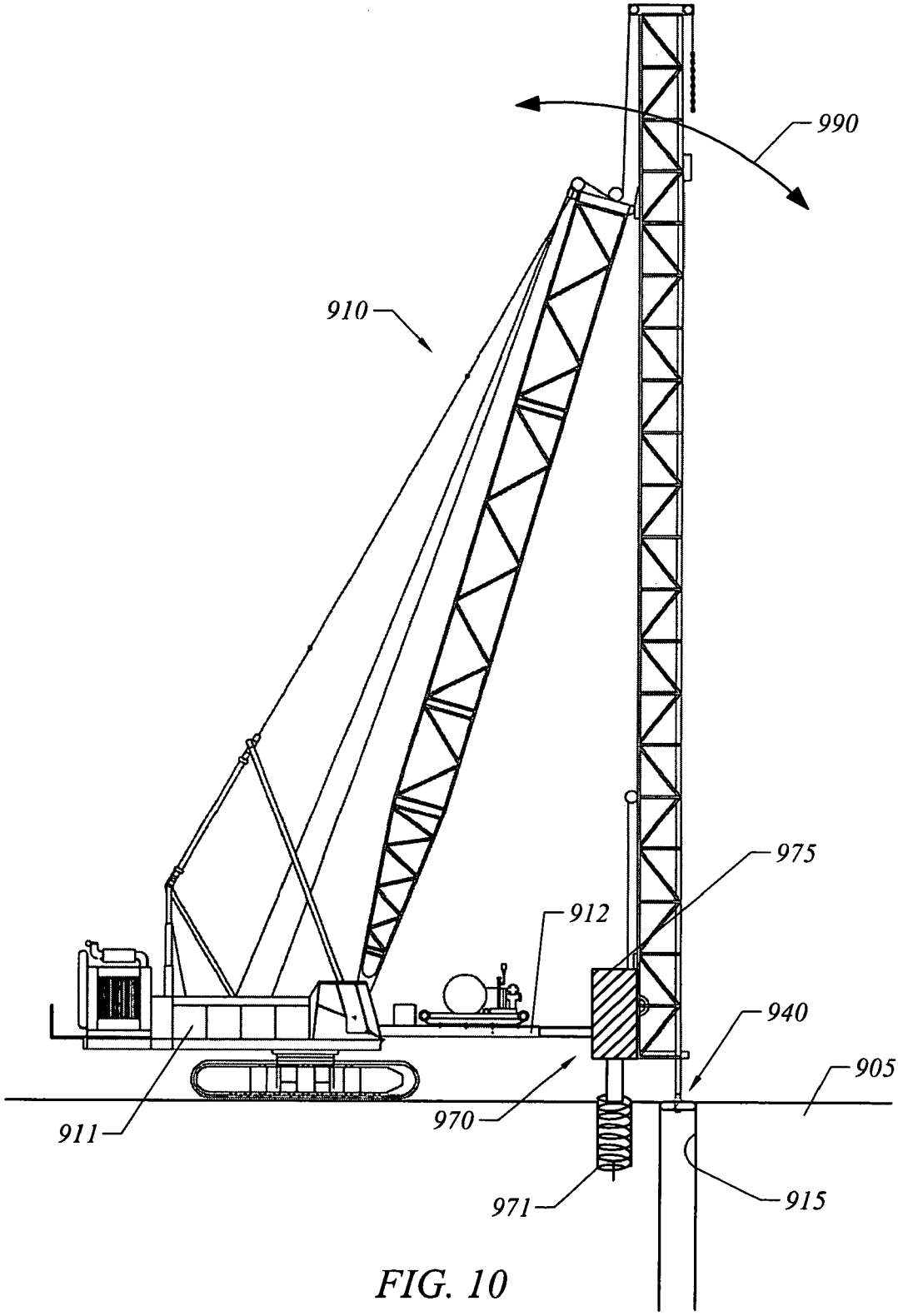
FIG. 10 is an illustration of a crane which has been outfitted with a stabilizer of the present invention to prevent rocking of the crane as the soil processing tool is advanced or withdrawn from the hole.

Another aspect of the present invention is a mechanism to minimize the "rocking" motion of the crane that supports the soil processing tool. As shown in FIG. 10, crane 910 is shown supporting a soil processing tool 940 according to the invention. The tool 940 is shown in the process of being lifted outwardly from hole 915. A stabilizer shown generally as 970 includes a helical anchor 971 driven into the ground 905. Helical anchor 971 is driven downwardly into the ground by drive mechanism 975 which is in turn rigidly attached to the frame 911 of crane 910 by one or more support rails 912. The purpose of helical anchor 971 is to prevent or limit the "rocking" motion of crane 910 that otherwise occurs in the direction of arrows 990 when the soil processing tool 940 encounters irregular subsoil conditions.

Figure 11:
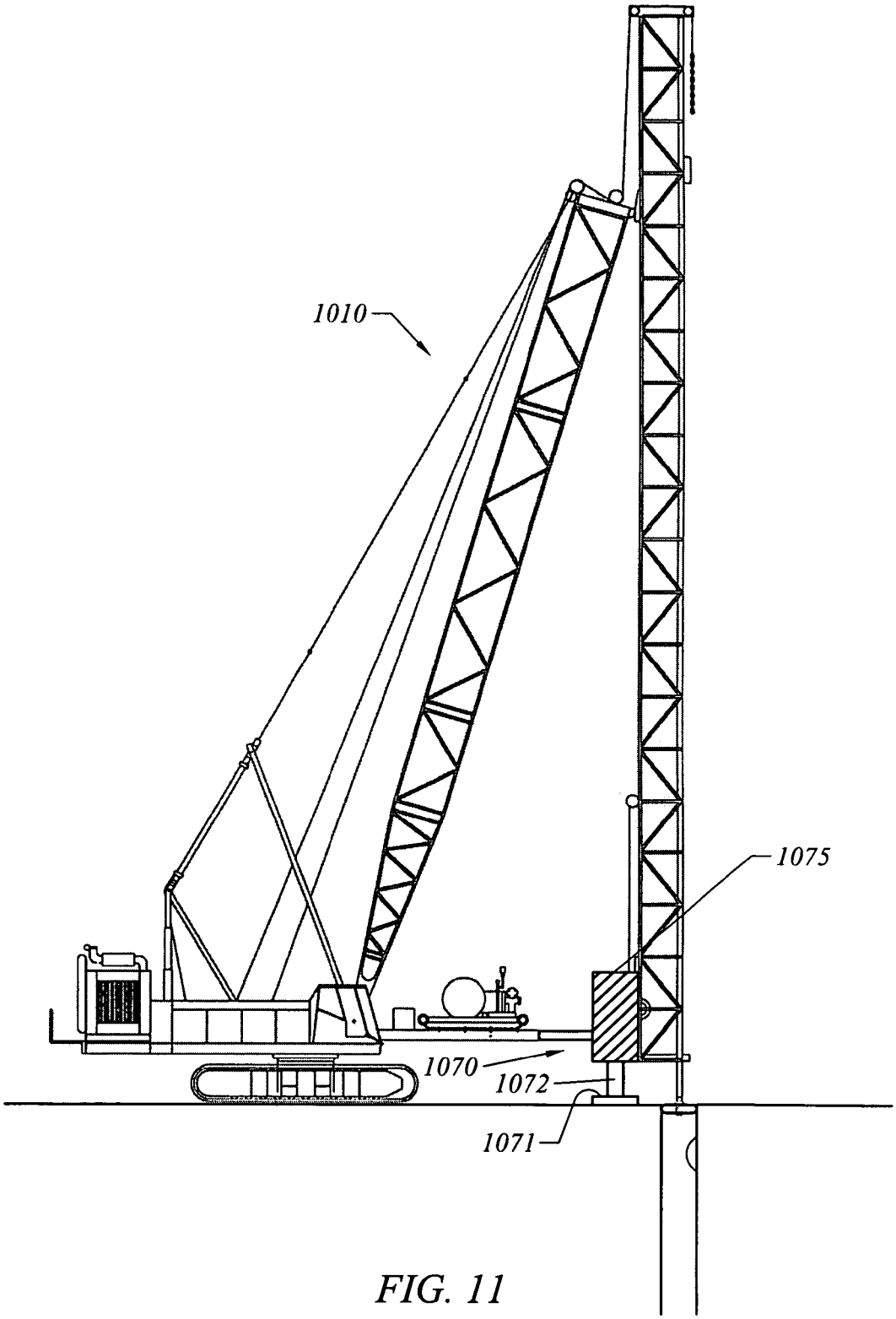
FIG. 11 is an illustration of a second type of stabilizer mechanism for the crane.

FIG. 11 illustrates an alternate embodiment of a stabilizer shown generally as 1070. Stabilizer 1070 includes an outrigger foot 1071 carried by a retractable shaft 1072. Retractable shaft 1072 is actuated by a hydraulic motor 1075 which extends the outrigger foot 1071 to a selected position and rigidly holds the foot 1071 in that position. The hydraulic outrigger foot mechanism shown in FIG. 11 is primarily for use only where the subsoil is firm enough to prevent the aforementioned rocking motion of the crane 1010.

Figure 12:
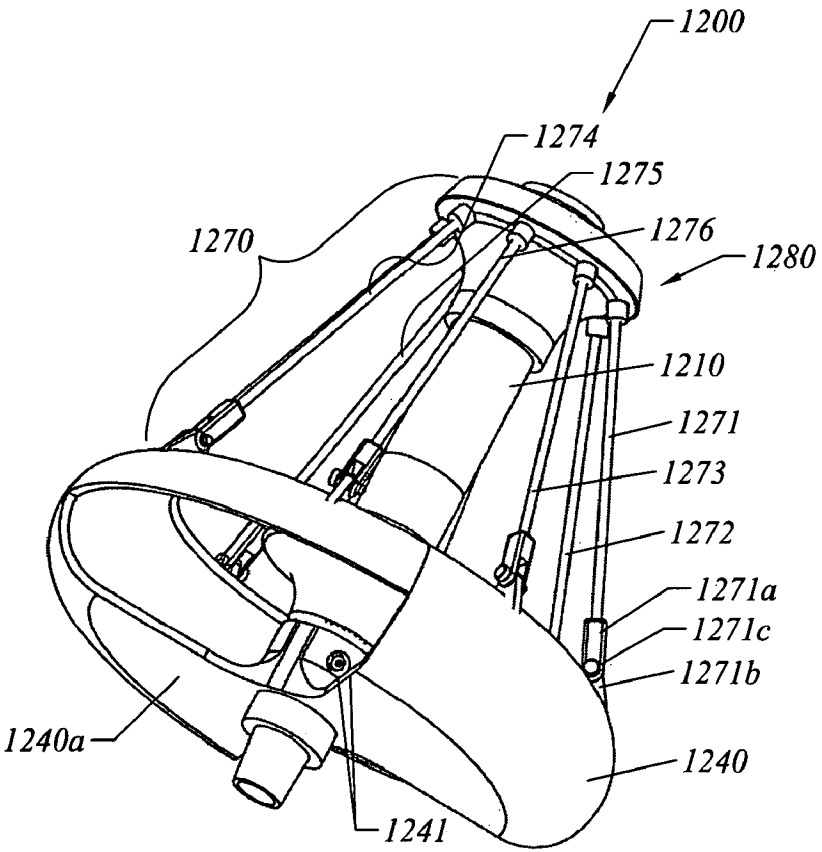
FIG. 12 is a bottom perspective view of another embodiment of the invention wherein an upper support structure is provided to strengthen the tool as it is being driven downwardly into the hole and as it is being withdrawn upwardly.

FIG. 12 is a perspective bottom view of another embodiment of the cyclonic mixing tool, shown generally as 1200.

Figure 13:
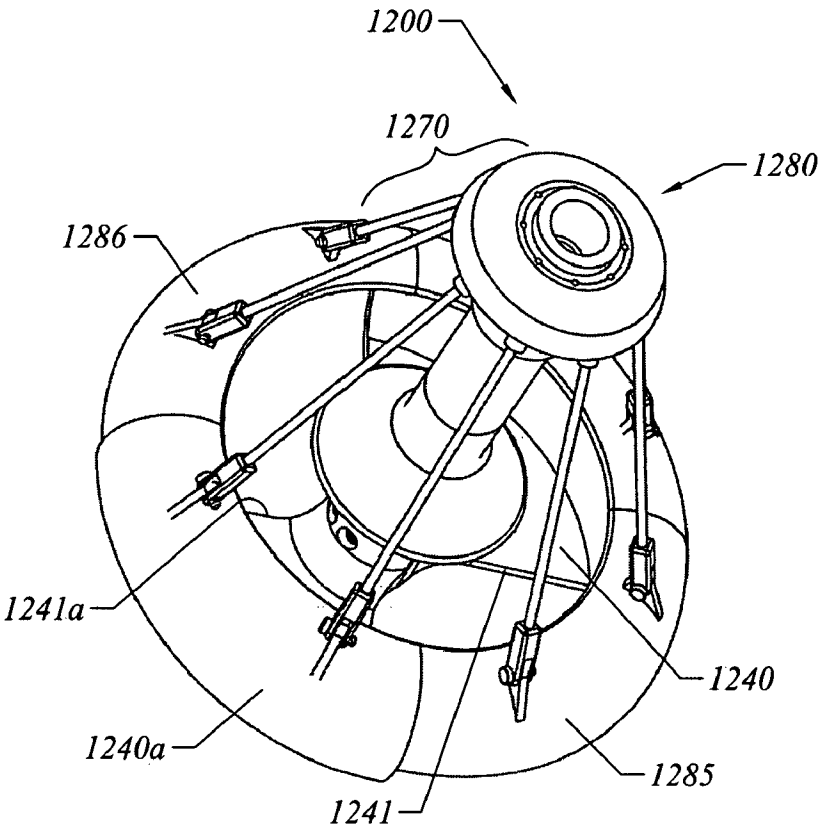
FIG. 13 is a perspective view of the tool shown in FIG. 12 looking down on the tool.

FIG. 13 is also a perspective view of the tool 1200 as shown in FIG. 12. Whereas FIG. 12 looks at the tool from a bottom angle, FIG. 13 views the same tool from an upward inclined angle. The tool 1200 includes two contoured flights 1240 and 1240*a*, having cutting edges 1241 and 1241*a* with cutting teeth deleted for clarity. Connectors 1285 and 1286 are placed between the upper portions of contoured flights 1240 and 1240*a* to strengthen the tool 1200. Connectors 1285 and 1286 have curved surfaces and form a circle (as shown in FIG. 13) with contoured flights 1240 and 1240*a*.

According to the present invention, an upper support referred to generally as 1270 includes a plurality of 8 struts, 6 of which are visible in FIG. 12 as 1271-1276. Each of the struts is anchored at their lower ends to the upper portion of contoured flights 1240, 1240*a* and connectors 1285 and 1286. For example, anchor 1271*a* at the lower end of strut 1271 is permanently attached to the upper surface of contoured flight 1240 as by welding a fixed plate 1271*b* which is pinned to anchor 1271*a* by pin 1271*c*. Each of the struts is connected to an upper flange 1280 which has a smaller diameter than flight 1240. Flange 1280 slides over the hollow Kelly 1210. The upper ends of each strut are rigidly attached to flange 1280. The attachment may be by threading or welding. The flange 1280 is preferably attached to hollow Kelly 1210 by welding or other means of permanent attachment.

The purpose of the array of struts is to stabilize the tool 1200 as it is driven downwardly into the in situ soil. The struts reduce the tendency of tool 1200 to bend upwardly as it is driven downwardly into the soil.

A secondary and equally important purpose of the struts 1270 is to provide strength to the tool 1200 as the tool is raised upwardly out of the hole after a soil cement column has been formed in the hole. The soil cement column forms a "gel" as it begins to set up and the tool 1200 must have sufficient strength to be able to be lifted through the gel without deforming. The array of struts 1270 provides tool 1200 with strength as it is being lifted out of the hole against the downward force of the soil cement gel.

In FIGS. 12 and 13, each of the struts such as 1271 is formed with a circular cross section.

Figure 15:
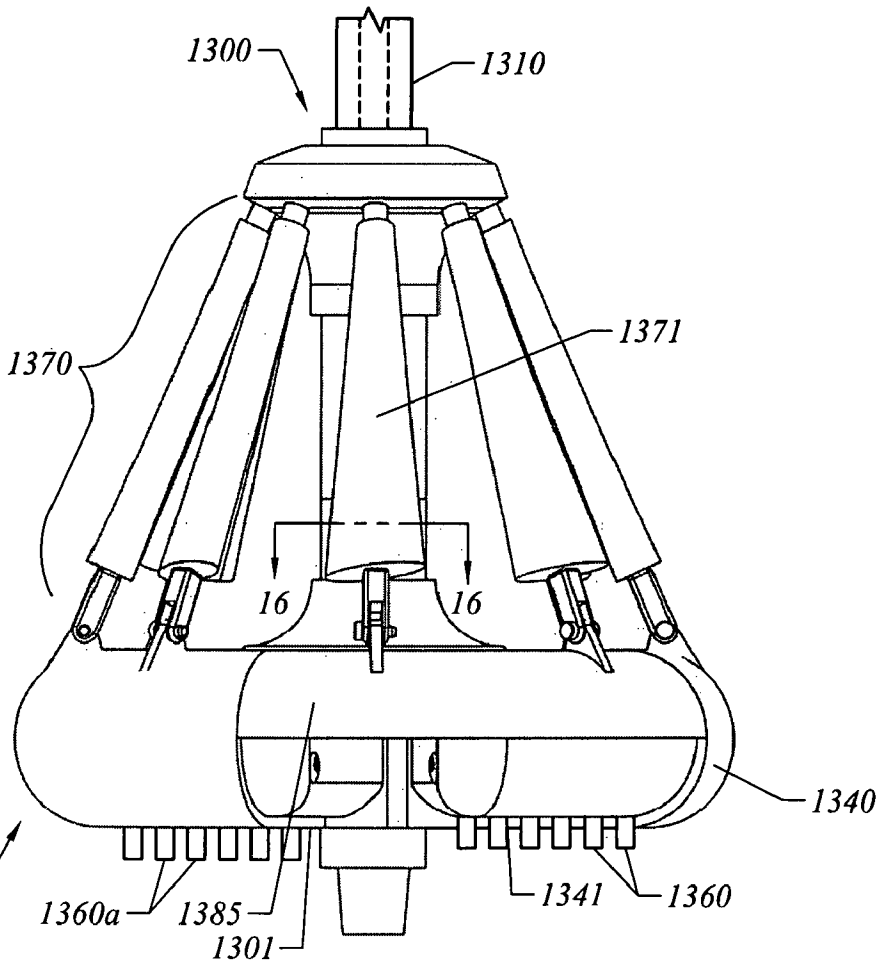
FIG. 15 is a side elevational view of the tool illustrated in FIG. 14.
Figure 14:
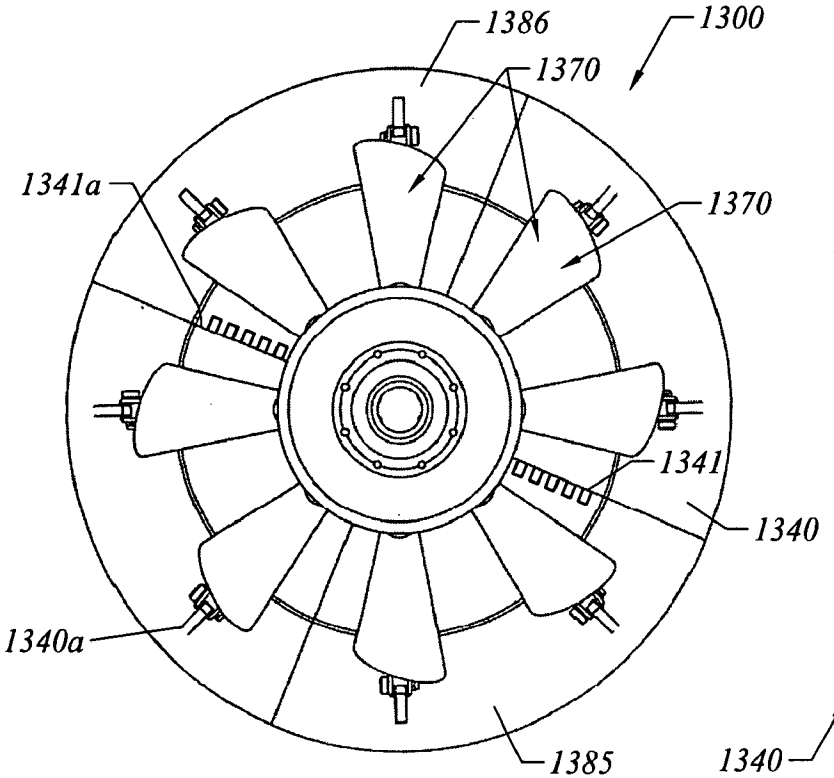
FIG. 14 is a top plan view of a further embodiment of the tool having an upper support structure with elliptically shaped support arms.

FIGS. 14 and 15 show another embodiment of the invention. Tool 1300 is similar to tool 1200. Tool 1300 has a flat bottom 1301 (FIG. 15), i.e., the contoured flights 1340 and 1340*a* are not inclined upwardly. Flights 1340 and 1340*a* subtend an arc of between 70° and 110° around the longitudinal axis of hollow Kelly 1310. Cutting edges 1341 and 1341*a* are on opposite sides of hollow Kelly 1310 and are positioned 180° apart, and each carries a set of teeth 1360 and 1360*a* which extend downwardly below bottom surface 1301. The teeth 1360 and 1360*a* may be sized differently (i.e. the depth they extend below bottom 1301) for different jobs. It is believed the flat bottom tool 1300 will perform best in clay subsoil, with the teeth extending 0.5 inch to 2.0 inches below flat bottom 1301.

As shown in FIGS. 14 and 15, an alternate upper support 1370 is shown as applied to tool 1300. Tool 1300 is the same as tool 1200 except for the struts such as 1371. Each strut such as 1371 has an elliptical cross section. The purpose of this elliptical cross section is to assist in the "troweling" aspect of the invention. The "troweling" aspect of the invention occurs as the tool 1300 is lifted out of the hole through the freshly formed soil cement mixture, the elliptical struts such as 1371 tend to urge the soil cement outwardly toward the outer edge of the hole.

Figure 16:
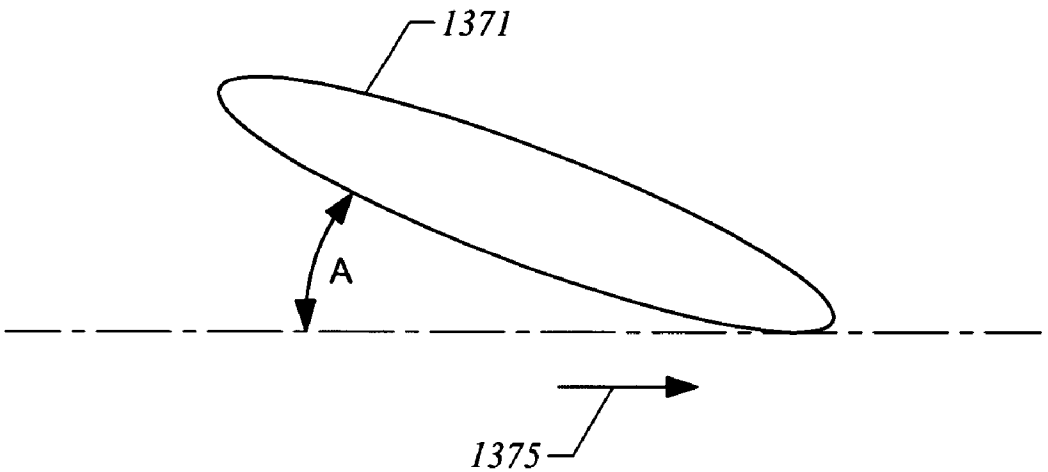
FIG. 16 is a sectional view on the line 16-16 of FIG. 15.

A further aspect of the present invention is that, as shown in FIG. 16 (a section on the line 16-16 of FIG. 15), each strut has an elliptical cross-section inclined at an angle A relative to the direction of rotation 1375 of tool 1300 of preferably 20° to increase the "troweling" effect. As the tool is being extracted and rotated in the direction of arrow 1375 of FIG. 16, each of the inclined struts 1371 urges the soil cement mixture outwardly as the tool is being lifted upwardly out of the hole. This increased pressure somewhat intensifies the "troweling" effect created by the tool 1300 as it is lifted upwardly out of the hole. The outer and upper curved surfaces of tool 1300 also contribute to this "troweling" effect. Each strut may be repositioned angularly to urge the soil cement inwardly if needed to help retract the tool.

Various numbers of struts may be utilized within the spirit of this invention. Various anchoring techniques for the upper and lower ends of each strut may also be utilized. Each of the upper and lower ends of each strut may be adjustable, depending upon the circumstances of use.

Figure 17:
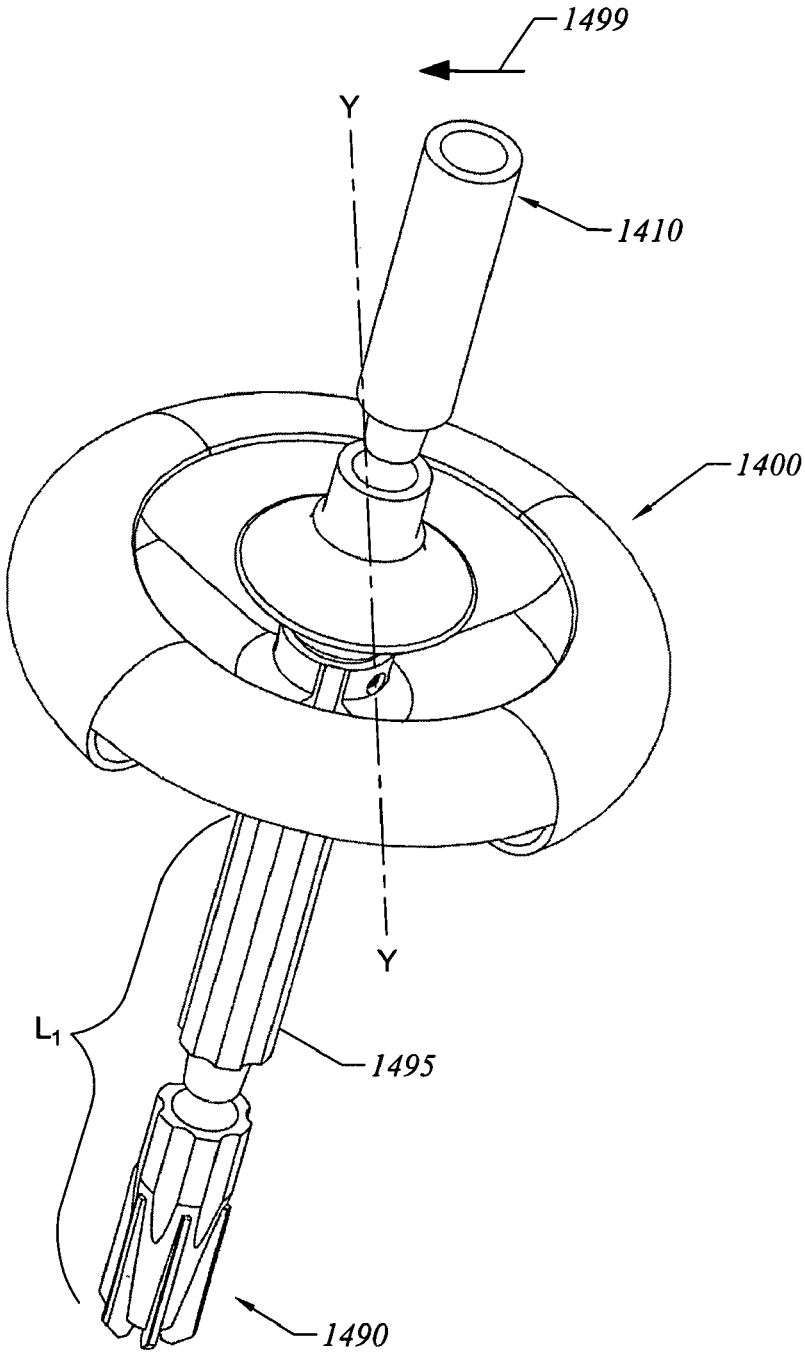
FIG. 17 is a schematic illustration of a further embodiment of the tool wherein a pilot bit is carried by the tool to allow the tool to be steerable from above ground by manipulation of a crane.

A novel "steerability" feature of the invention is illustrated in FIG. 17. The cyclonic tool is shown as 1400 without the array of struts for clarity. Tool 1400 is shown connected to a pilot bit 1490. Pilot bit 1490 is carried at the end of shaft 1495. The length L, represents the distance below tool 1400 that pilot bit 1490 extends in the hole. If the pilot bit 1490 for any reason is deflected, the cutting tool 1400 may be "steered" to correct the unwanted deflection by simply moving the top of the hollow Kelly in the direction to change the orientation of the pilot bit 1490 to the desired orientation. For example, in FIG. 17, pilot bit 1490 is inclined somewhat to the left of a vertical line Y-Y. To correct the orientation of pilot bit 1490 and tool 1400, a computerized system automatically senses the unwanted deflection of pilot bit 1490 and automatically moves the upper end of hollow Kelly 1410 in the direction of arrow 1499. It should be noted that the deflection illustrated in FIG. 17 is greatly exaggerated for purposes of illustration. As a practical matter, deflections of one or two degrees can be easily detected and corrected by computer control. The "steerability" of the present invention is made possible by the relative short vertical cross section of cutting tool 1400. A typical prior art tool will have a vertical cross section extending 5 or 10 times the magnitude of the vertical cross section of tool 1400. The greater length cross-section of the prior art prevents or resists lateral movement from above to effect steering corrections to the pilot below. The present invention may be steered manually, but computerized steering is preferable.

Figure 18:
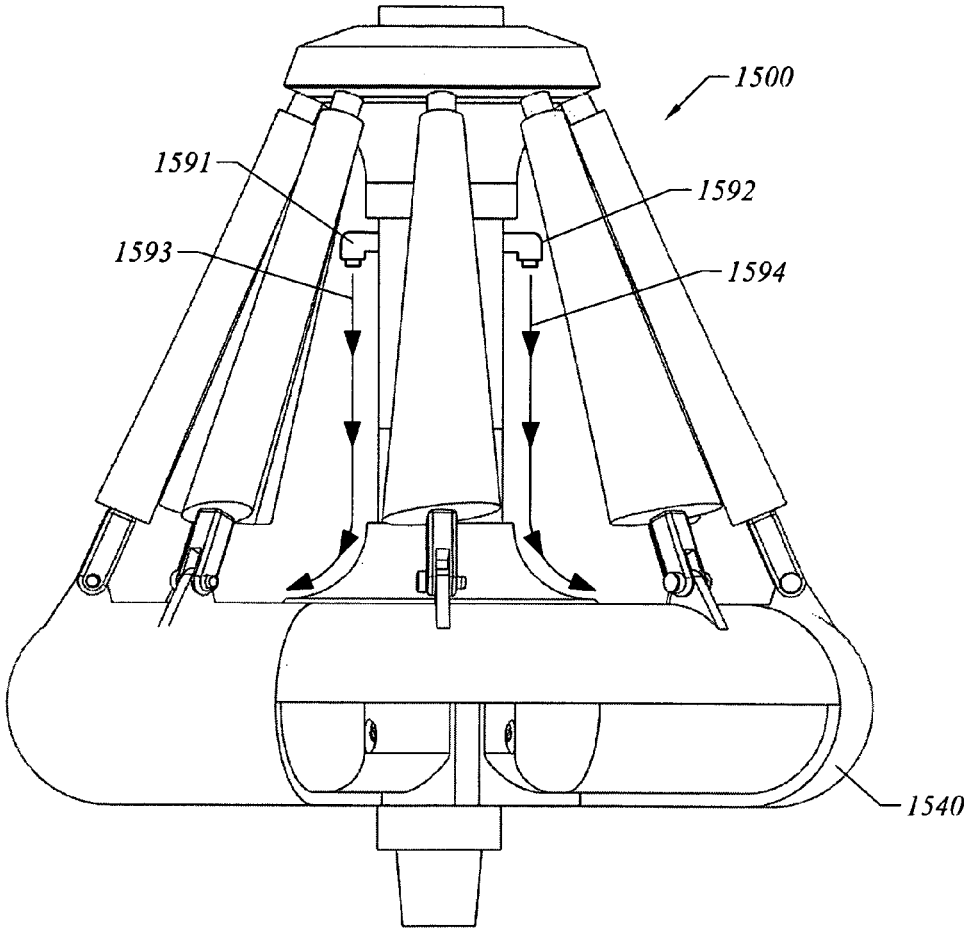
FIG. 18 is a further embodiment of the invention wherein a pair of relatively small agitator nozzles are carried to loosen cementitious slurry that might otherwise harden and prevent the tool from being withdrawn from the hole it has created.

FIG. 18 illustrates an alternate embodiment of the invention wherein tool 1500 has been provided with a pair of agitator nozzles 1591 and 1592. Agitator nozzles 1591 and 1592 are intended to loosen any cementitious slurry that is hardening which would otherwise prevent the tool 1500 from being retracted upwardly out of the hole it has formed. Agitator nozzles 1591 and 1592 have jetstreams 1593 and 1594, respectively, that are oriented downwardly. These jetstreams comprise fresh slurry that tends to loosen and prevent any slurry from hardening and preventing the tool from being lifted upwardly out of the hole. The agitator nozzles 1591 and 1592 are optional and are only believed to be necessary for extremely deep holes. The nozzles 1591 and 1592 would be plugged or capped until needed.

The cyclonic mixing region in any of the above embodiments will greatly increase the efficiency of the mixing process. Whereas the minimum jetstream velocity in the prior art (namely, U.S. Pat. No. 4,958,962) was 300 fps, that minimum velocity will drop to about 200 fps with the present invention (to achieve results similar to those of the prior art at 300 fps). Reduction of minimum velocity reduces the power required. Furthermore, the maximum velocity of the jetstream may be increased, since the jetstream is prevented from impacting the side wall of the hole. The previous maximum of 2500 fps is no longer in effect. The maximum jetstream velocity is now limited by pump pressures and the ability of the flight to withstand the abrasive nature of the jetstream.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application to thereby enable others skilled in the art to best use the invention in various embodiments and with various modifications suited to the particular use contemplated. The scope of the invention is to be defined by the following claims.

What is claimed is:

1. A method of forming in situ soil cement columns and other structures in a subterranean earth situs where a soil processing tool carried by a hollow Kelly is advanced into said situs to form a hole and to break said material into pieces; and while advancing said soil processing tool into said situs, introducing a jetstream having water and a solidifying agent into said pieces from said tool to hydraulically divide said pieces into very fine particles and to admix said solidifying agent with said particles whereby a uniform admixture of said solidifying agent and said particles is achieved; and thereafter allowing said admixture of said solidifying agent and said material to harden, the improvement comprising the following step:

forming a cyclonic mixing region by deflecting said jetstream through an angle greater than 110° and preventing said jetstream from impacting the side wall of said hole.

2. The method of claim 1 wherein said admixture in said cyclonic mixing region rotates about a generally horizontal axis.

3. The method of claim 1 wherein said jetstream is introduced by velocities greater than 2500 feet per second without impacting and wearing away the side wall of the hole produced by said tool.

4. The method of claim 1 comprising the further step:

troweling the side wall of the hole produced by said tool as said tool is withdrawn from said hole.

5. The method of claim 1 wherein said tool has a cutting edge and wherein said jetstream is introduced in a direction parallel to said cutting edge.

6. The method of claim 5 wherein said jetstream is introduced at a position adjacent said cutting edge.

7. The method of claim 2 wherein two or more jetstreams are utilized to create said cyclonic mixing region, said jetstreams being spaced apart around said generally horizontal axis.

8. The method of claim 1 wherein said tool has a contoured flight and wherein said contoured flight has a plurality of ribs on its surface, said ribs being in the pathway of said jetstream, said ribs causing turbulence of said jetstream.

9. The method of claim 1 wherein said tool is supported by a crane and wherein a stabilizer is placed between said crane and the ground to prevent said crane from rocking as said tool is advanced and withdrawn.

10. The method of claim 1 wherein said jetstream is introduced at a velocity greater than 200 feet per second.

11. The method of claim 1 wherein said tool has a flight with a central section and wherein said jetstream is oriented downwardly relative to said central section at an angle up to 30°.

12. The method of claim 1 wherein said jetstream flows outwardly from said hollow Kelly and is deflected and redirected so that it flows back towards said hollow Kelly.

13. In a soil processing tool for forming in situ subterranean soil cement structures, wherein said tool includes a hollow Kelly, said hollow Kelly having a longitudinal axis, one or more flights, cutting teeth carried by said flights, and one or more injection nozzles for injecting a high pressure jetstream of cementitious slurry into said situs, the improvement comprising:

a contoured flight, said contoured flight having a central section extending transversely relative to said longitudinal axis of said Kelly, and having an exterior contoured section extending upwardly relative to said central section, wherein the surface of said exterior contoured section bends through an angle greater than 110° relative to said central section, whereby said exterior contoured surface deflects and redirects said jetstream to form a cyclonic mixing region.

14. The apparatus of claim 13 wherein said contoured flight has a cutting edge and wherein an injection nozzle is positioned adjacent said cutting edge.

15. The apparatus of claim 14 wherein said nozzle is oriented so that its jetstream is parallel to said cutting edge.

16. The apparatus of claim 14 wherein said nozzle is oriented so that its jetstream is perpendicular to the longitudinal axis of said hollow stem auger and so that its jetstream forms an angle with said cutting edge of between 0° and 45°.

17. The apparatus of claim 13 wherein a first nozzle is oriented so that its jetstream flows away from said hollow Kelly, wherein a second nozzle is oriented so that its jetstream flows toward said hollow Kelly, and wherein said jetstreams are spaced apart from each other vertically.

18. The apparatus of claim 13 wherein said hollow Kelly has first and second flights, wherein each flight has a cutting edge and wherein said cutting edges are on opposite sides of the longitudinal axis of said hollow Kelly.

19. The apparatus of claim 18 wherein said cutting edges for said first and second flights are positioned 180° apart.

20. The apparatus of claim 19 wherein each flight subtends an arc around the longitudinal axis of said hollow Kelly of between 70° and 110°.

21. The apparatus of claim 20 wherein said first and second flights are flat and have no upward inclination.

22. The apparatus of claim 18 wherein the cutting edge of each flight carries cutting teeth that extend downwardly below said flat bottom.

23. The apparatus of claim 20 further comprising a support structure including a plurality of arms extending upwardly from said first and second flights and said arms are connected to an upper flange.

24. The apparatus of claim 23 further comprising one or more agitator nozzles mounted below said flange to loosen cementitious slurry that would otherwise harden and prevent said tool from being withdrawn from said subterranean situs.

25. The apparatus of claim 23 wherein said arms each have an elliptical cross-section and wherein said arms may be positioned to urge the soil cement mixture outwardly or inwardly.

26. The apparatus of claim 18 further comprising a second, smaller tool carried by said hollow Kelly and positioned below the other tool to act as a pilot tool.

* * * * *